US007373795B2

(12) United States Patent
Kilbourne

(10) Patent No.: US 7,373,795 B2
(45) Date of Patent: May 20, 2008

(54) UNIVERSAL REMOTE DEADBOLT ADAPTER

(76) Inventor: Mark W. Kilbourne, 2634 Yorktown, #392, Houston, TX (US) 77056

( * ) Notice: Subject to any disclaimer, the term of this patent is extended or adjusted under 35 U.S.C. 154(b) by 0 days.

(21) Appl. No.: 11/005,687

(22) Filed: Dec. 7, 2004

(65) Prior Publication Data

US 2006/0117819 A1 Jun. 8, 2006

(51) Int. Cl.
*E05B 49/00* (2006.01)
*E05B 65/06* (2006.01)

(52) U.S. Cl. ..... 70/278.1; 70/129; 70/280; 70/379 R; 70/462; 292/244

(58) Field of Classification Search ..... 70/277, 70/441, 124, 129, 280–282, 278.1, 379 R, 70/379 A, 380, 460, 462; 292/244
See application file for complete search history.

(56) References Cited

U.S. PATENT DOCUMENTS

RE29,846 E * 11/1978 Genest et al. ..... 70/280
5,027,629 A * 7/1991 Liu ..... 70/277
5,790,034 A * 8/1998 Khoury ..... 70/277
5,936,544 A * 8/1999 Gonzales et al. ..... 70/277
5,987,945 A * 11/1999 Ruano Aramburu ..... 70/277
6,012,310 A * 1/2000 Hsiao ..... 70/278.2
6,035,676 A * 3/2000 Hudspeth ..... 70/280
6,145,353 A * 11/2000 Doucet ..... 70/277
6,259,352 B1 * 7/2001 Yulkowski et al. ..... 70/277
6,418,763 B1 * 7/2002 Huang ..... 70/278.7
6,517,127 B1 * 2/2003 Lu et al. ..... 70/280
6,739,164 B2 * 5/2004 Warmack ..... 70/278.1
2003/0094023 A1 * 5/2003 Emiel Van Parys ..... 70/257

* cited by examiner

*Primary Examiner*—Patricia Engle
*Assistant Examiner*—Christopher Boswell
(74) *Attorney, Agent, or Firm*—The Matthews Firm

(57) ABSTRACT

A system for electronically and remotely activating a deadbolt lock to actuate and either extend or retract a deadbolt into a door or barrier. The system can be activated by remote control or by a manual knob. The system is constructed so as to fit on any standard single cylinder, cylindrical deadbolt system and utilize the existing deadbolts keys. The system can be used in homes, apartments, or other buildings.

20 Claims, 10 Drawing Sheets

(CONTINUED ON SHEET 10/10)

UNIVERSAL REMOTE DEADBOLT ADAPTER

TECHNICAL FIELD

The present system and apparatuses relate generally to systems, apparatuses and methods operable for automatically moving deadbolts or throws in deadbolt locks, more particularly, the system and apparatus are especially suitable for activating deadbolt locks for use in houses or apartments and is easily assembled and disassembled to allow user to take the system and apparatus to different locations without compromising the system and apparatus or the door to which the system and apparatus is attached.

BACKGROUND ART

Prior art in the field includes independent dual locking deadbolts which work through a single key pivot, thereby securing a door or portal with two deadbolts positioned through two different areas on the door frame, floor or wall. Prior art also includes extending the length of the deadbolt running through one door frame, floor or wall, thereby strengthening the deadbolt anchor through the door and increasing the security provided by the deadbolt.

The present inventive system and apparatus provides for an electronic means for activating a deadbolt to be engaged in the door frame or disengaged from the door frame. The use of the electronic means of activating a deadbolt lock will assist users who forget to bring the keys to manually open the deadbolt lock and also those who may have difficulty in manipulating a deadbolt manually. Several other advantages of the present apparatus and system will be readily apparent to those skilled in the art.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DETAILED DESCRIPTION OF THE PREFERRED EMBODIMENTS

For a further understanding of the nature, function, and objects of the present invention, reference should now be made to the following detailed description taken in conjunction with the accompanying drawings. Detailed descriptions of the embodiments are provided herein, as well as a mode of carrying out and employing embodiments of the present invention. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system and apparatus, structure, or manner. The practice of the present invention is illustrated by the following examples which are deemed illustrative of both the process taught by the present invention and of the product and article of manufacture yielded in accordance with the present invention. It is important to note that throughout all of the embodiments (disclosed below) it should be understood that the location of the gears and motor(s) is variable and that rearrangements of the gears would be readily apparent to those skilled in the art. It is important to note that several states have enacted statutes regarding rental property, that require two deadbolt locks to be placed on the entry door. These security locks are typically combined with one lockset utilized for opening and closing the door. As an example, the State of Texas requires that the locks be installed no more than forty eight inches above the floor and no less than thirty six inches above the floor, thereby allowing for twelve inches of workspace.

Figure 1A:
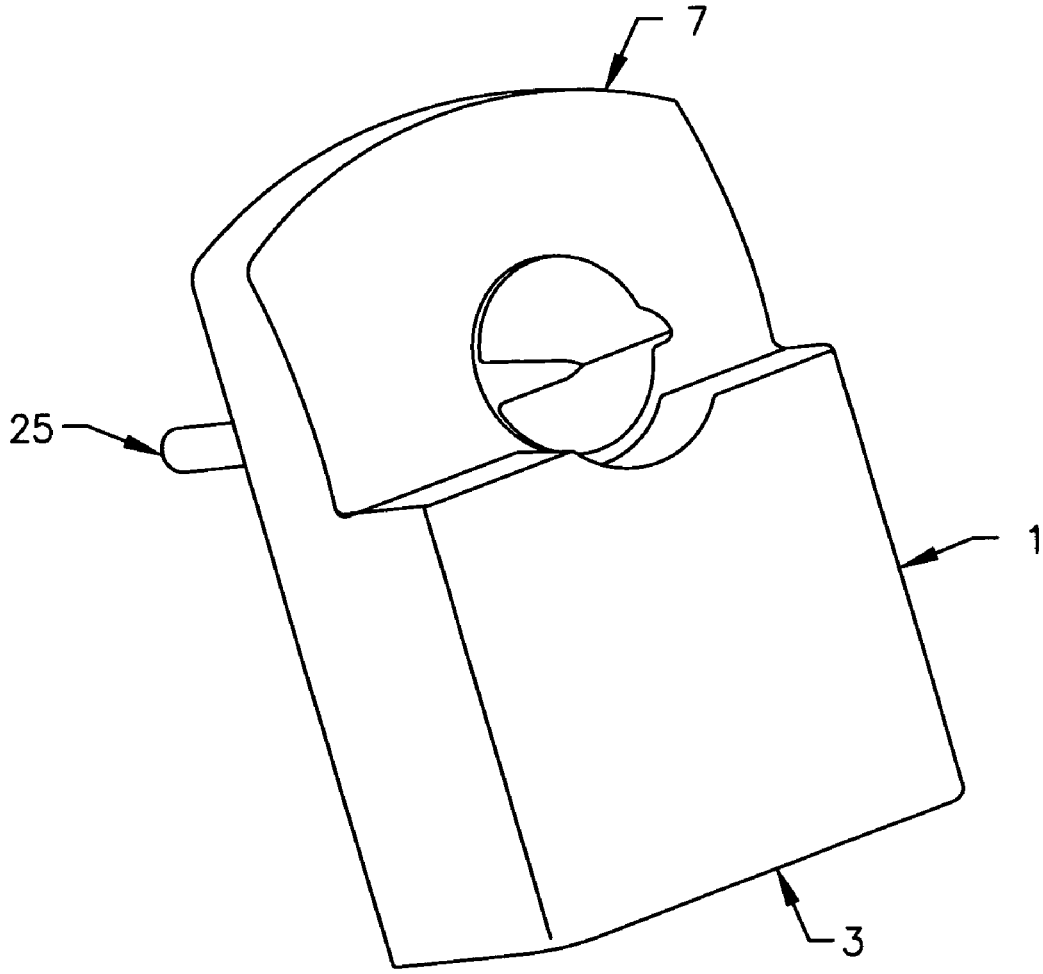
FIG. 1A illustrates a side of the fully assembled apparatus which is the subject of the current invention.
Figure 1B:
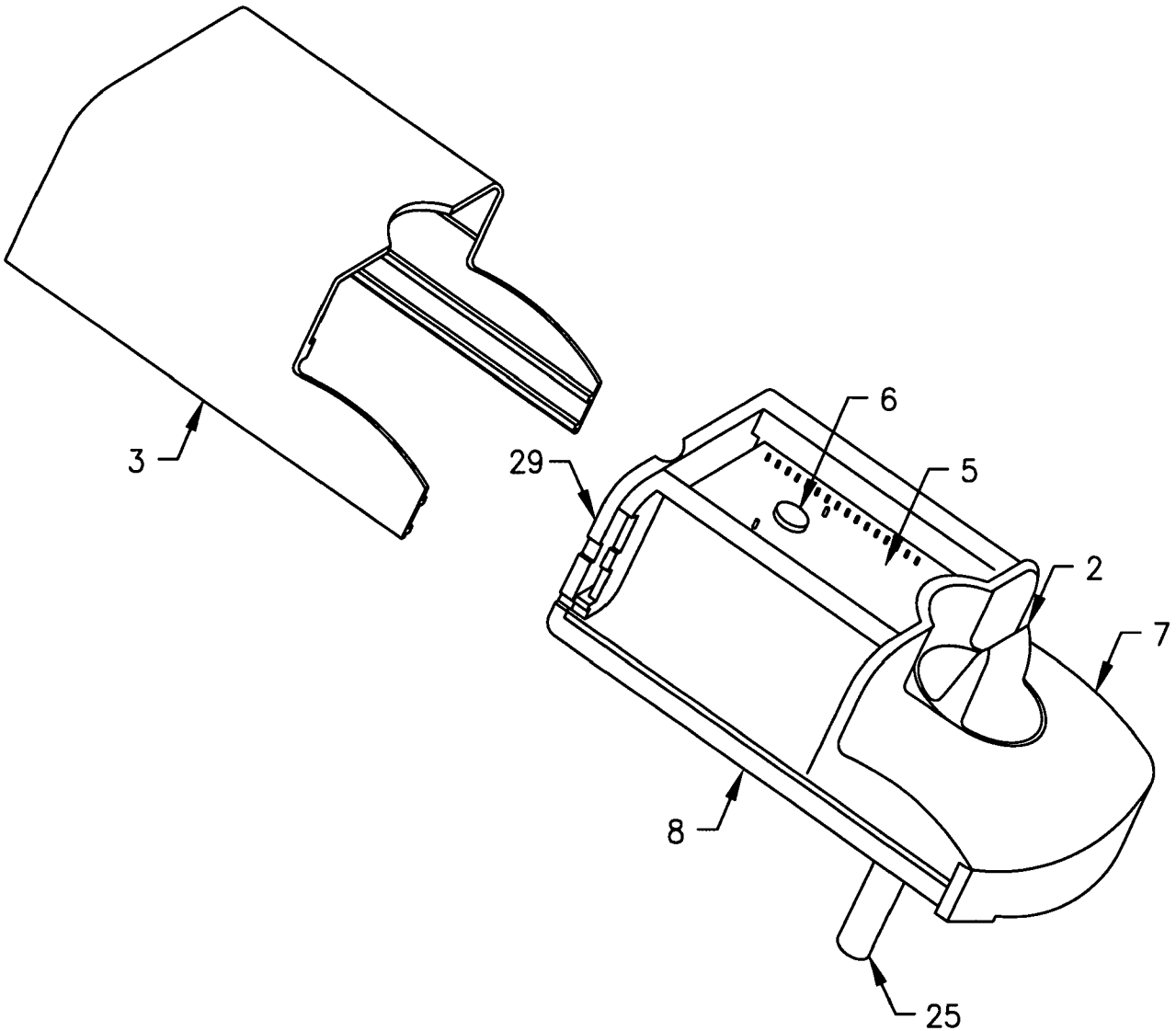
FIG. 1B illustrates a partially exploded view of the assembled apparatus which is the subject of the current invention.

Referring now to the drawings and, more particularly to FIG. 1A and FIG. 1B. FIG. 1A illustrates the unit base 1. Unit base 1 is preferably, but not limited to, a size to fit on a standard, conventional door frame. However, unit base 1 can easily be modified to fit on any threshold barrier that utilizes a deadbolt system and apparatus by merely enlarging the individual components of the unit base 1 as necessary. It should be appreciated that the present unit base 1, can be preferably constructed so as to fit within a twelve inch workspace allowed and thereby comply with Texas state law and other states' laws as well. FIG. 1A illustrates various components of the unit base 1 as can be seen externally on a completed unit base 1 unit. The two largest and most easily visible components of the unit base 1 are the back casing 3 and motor and battery housing unit 7. The back casing 3 substantially offers covered protection of delicate machinery housed internally in the motor and battery housing unit 7. The back casing 3, may be composed of any lightweight material, which can be, but is not limited to plastic, aluminum, or composite material. The back casing 3 preferably has a front end and a back end such that the front end is shaped to releasably engage a track, groove or other engagement surface on the motor and battery housing unit 7. The back casing 3 preferably has a back end shaped such that back end forms a three dimensional enclosure capable of either fully or partially enclosing an area (preferably the back end of the motor and battery housing unit 7)(FIG. 1*b*). Upon engagement between the motor and battery housing unit 7 and the back casing 3, the back casing 3 can traverse the motor and battery housing unit 7, thereby creating a covering of varying areas of motor and battery housing unit 7. The motor and battery housing unit 7 is preferably constructed with a front end and a back end. The motor and battery housing unit 7 back end is preferably constructed with a substantially hollow, and open floored bed or containment area capable of holding the motor 15, the electronic motor card 5, the signal set button 6, and at least one motor gear 11 (FIG. 4). The back end of motor and battery housing unit 7 preferably contains a battery bank 8, which will contain and house the battery power supply for the unit base 1. The size of batteries needed will vary with the size and power requirements of the unit base 1, however it can be appreciated that for the conventional door 24 and deadbolt 27 standard AA batteries can be used. It is important to note that one skilled in the art could readily conceive of alternate power sources, including but not limited to, solar power, electrical cords, or other forms of energy powering units. The battery bank 8 are in a standard formation as utilized in the industry, such that the batteries, when placed in the battery bank 8 will provide a power through the electronic card 5 and supply power to the motor 15, sufficient to motivate the deadbolt 27 to which the unit base 1 is attached. Also visible externally on unit base 1 is the manual deadbolt turning knob 2. The manual deadbolt turning knob 2 is a conventional turning knob utilized in the industry and is constructed such that it can be preferably rotated or activated by the use of a thumb and finger(s) engaging the manual deadbolt turning knob 2 and rotating in either a clockwise or counterclockwise manner. Manual deadbolt turning knob 2 is located preferably on the front end of motor and battery housing unit 7. Back casing 3 is preferably indented to fit in the circular dial base of the manual deadbolt turning knob 2. On the bottom of the front end of motor and battery housing unit 7 and in mechanical communication with manual deadbolt turning knob 2 is splined stem 4. (FIG. 3) The splined stem 4 is utilized to attach the unit base 1 to the door or barrier 24 being secured by a deadbolt 27. The splined stem 4 attaches to the door deadbolt 27 in a conventional fashion. FIG. 1B illustrates the battery housing unit 7 being separated from the back casing 3. Clearly shown is a battery bank 8 and the back end of the battery housing unit 7 with a motor card 5 and the signal set button 6.

Figure 2:
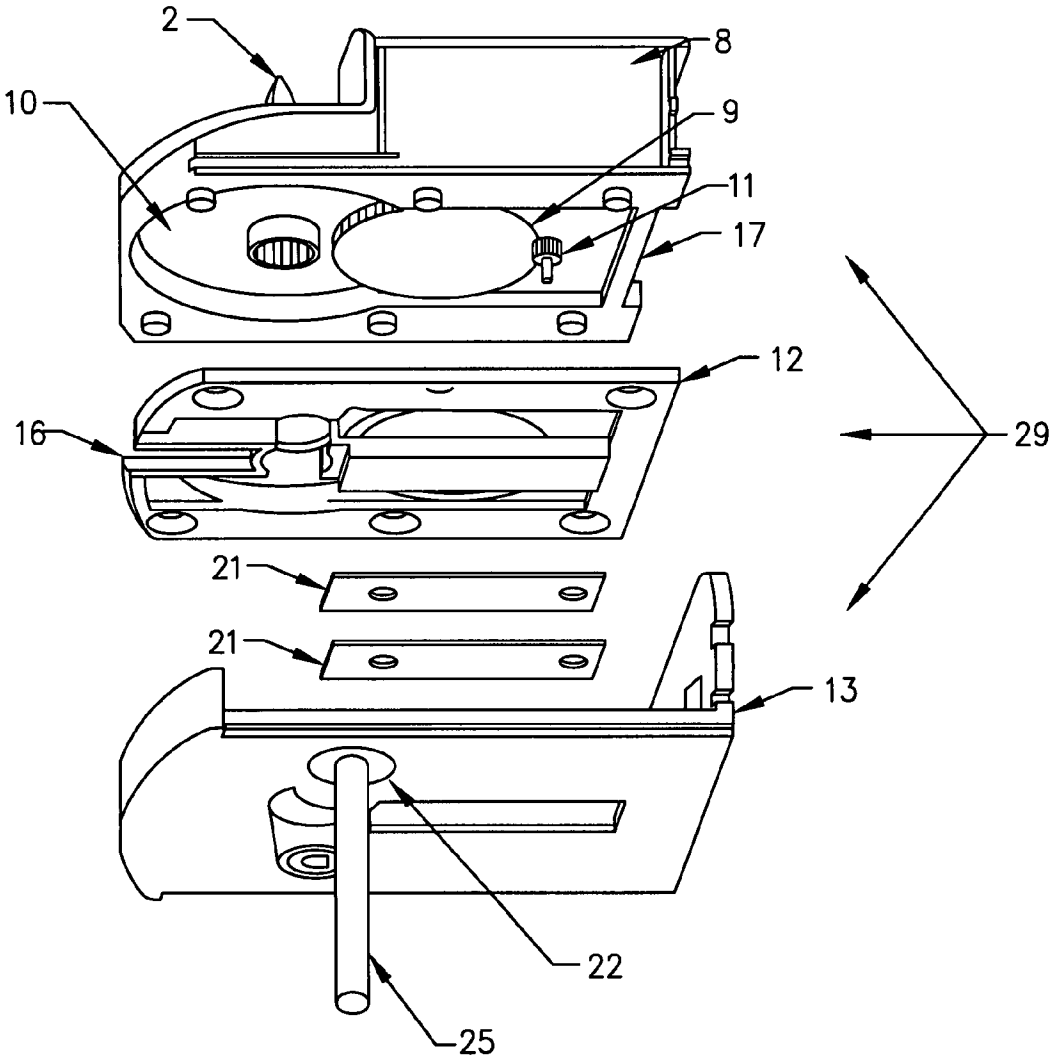
FIG. 2 illustrates a partially exploded bottom view of the apparatus which is the subject of the current invention.

FIG. 2 shows an exploded underside view of the unit base 1. The manual deadbolt turning knob 2 can be seen as it rests preferably anteriorly to the motor and battery housing unit carriage 17. Also visible is the battery bank 8. Posterior to the manual deadbolt turning knob 2 is the knob gear 10. The knob gear 10 is preferably a standard gear utilized in the industry and is in mechanical communication with the manual deadbolt turning knob 2 such that when either is motivated it will rotate and thereby cause the other to rotate as well. It should be appreciated that one of ordinary skill in the art could readily conceive of a plurality of knob gears 10 to manual deadbolt turning knob 2 embodiments which could include, but are not limited to, a direct attachment of gear 10 to manual deadbolt turning knob 2 with an adhesive, snap, screw on or other attachment means. A plurality of knob gears 10 utilized in a variety of mechanical communications such that a series of rotations and counter rotations is established, or other manual deadbolt turning knob 2 to knob gear 10 arrangements. The posterior of empty motor and battery housing unit carriage 17 is preferably shaped to sufficiently and engagably house knob gear 10 such that knob gear 10 is capable of rotational movement. It is preferable that knob gear 10 is not visible when the unit base 1 is assembled as a whole. Knob gear 10 has teeth preferably about its exterior such that the teeth are capable of mechanically engaging and activating another gear or series of gears. Knob gear 10 is capable of rotating in either a clockwise or counterclockwise manner, and can be in mechanical communication with manual deadbolt turning knob 2 such that both rotate in the same direction or are set to counter rotate in relation to each other. As illustrated in FIG. 2, knob gear 10 is proximal to the base of the posterior of the empty motor and battery housing unit carriage 17 whereby the knob gear 10 can interact and communicate in a mechanical manner with rotary gear 9. The rotary gear 9 is distal in relation to both empty motor and battery housing unit carriage 17 and/or knob gear 10, but is adjacent to knob gear 10. It should be appreciated by one skilled in the art that the knob gear 10 and rotary gear 9 may be combined in a myriad of embodiments and that the current embodiment is for illustrative purposes only. Located and in mechanical communication with rotary gear 9 is motor gear 11. Motor gear 11 is a standard gear utilized in the art and attached to a motor 15, such that when motor 15 is activated motor gear 11 rotates about its axis. Motor gear 11 and rotary gear 9 have teeth capable of engaging each other or knob gear 10. It should be noted that one skilled in the art could construct a myriad of functional gear arrangements including potentially a plurality of gears 9, 10, and 11 such that the unit base 1 would function fully. Motor gear 11 is attached to motor 15 in the conventional manner such that motor 15 will cause motor gear 11 to rotate upon activation. The empty motor and battery housing unit carriage 17 preferably rests on top of gear casing 12 such that gears 9, 10 and 11 are securely held between empty motor and battery housing unit carriage 17 and top of gear casing 12. Gear casing 12 is preferably constructed and/or molded such that there is a hollowed portion of sufficient size and shape to securely contain gears 9, 10 and 11 in such a manner that these gears can rotate without an impediment. Gears 9, 10 and 11 are preferably held within gear casing 12 by gear bracket 16, which can be shaped in a straight bar formation or any other suitable configuration necessary to hold the gears 9, 10, and 11 in place. The gear casing 12 is releasably attached to template unit 13. The template unit 13 is preferably constructed to fit flush against a door or barrier into which the deadbolt 27 is encased. Splined stem 4 extends from the middle of the template unit 13 and engages the deadbolt internal apparatus 28 sought to be attached. The template unit 13 is preferably attached to the internal door deadbolt apparatus 28 via bolts 25 which are attached to and protrude from moveable brackets 21 in the conventional manner. The unit base 1 is designed to utilized the bolts 25 that are part of the deadbolt it remotizes. Bolts 25 do not have to be bolts in the conventional sense but can be and are not limited to screws, rivets, pins and other pieces of attachment hardware. Orifices 22 are of preferable size to encompass any standard door or barrier hole which encloses a standard single cylinder, cylindrical, deadbolt mechanism 28. Bolts 25 and brackets 21 are preferably composed of a metal or hard composite material such as, but not limited to, steel, iron plastics or other combinations of materials. When door bolts 25 are tightened to the brackets 21 and the internal door bolt mechanism, the template unit 13 is securely held to the door or barrier. The empty motor and battery housing unit carriage 17, gear casing 12 and template unit 13 attach with each other to form the complete gear encasement assembly 29. If the gears 9, 10, and 11, the electronic card 5 and the signal set button 6 are included in the complete gear encasement assembly 29 then the unit is a motor and battery housing unit 7.

Figure 3:
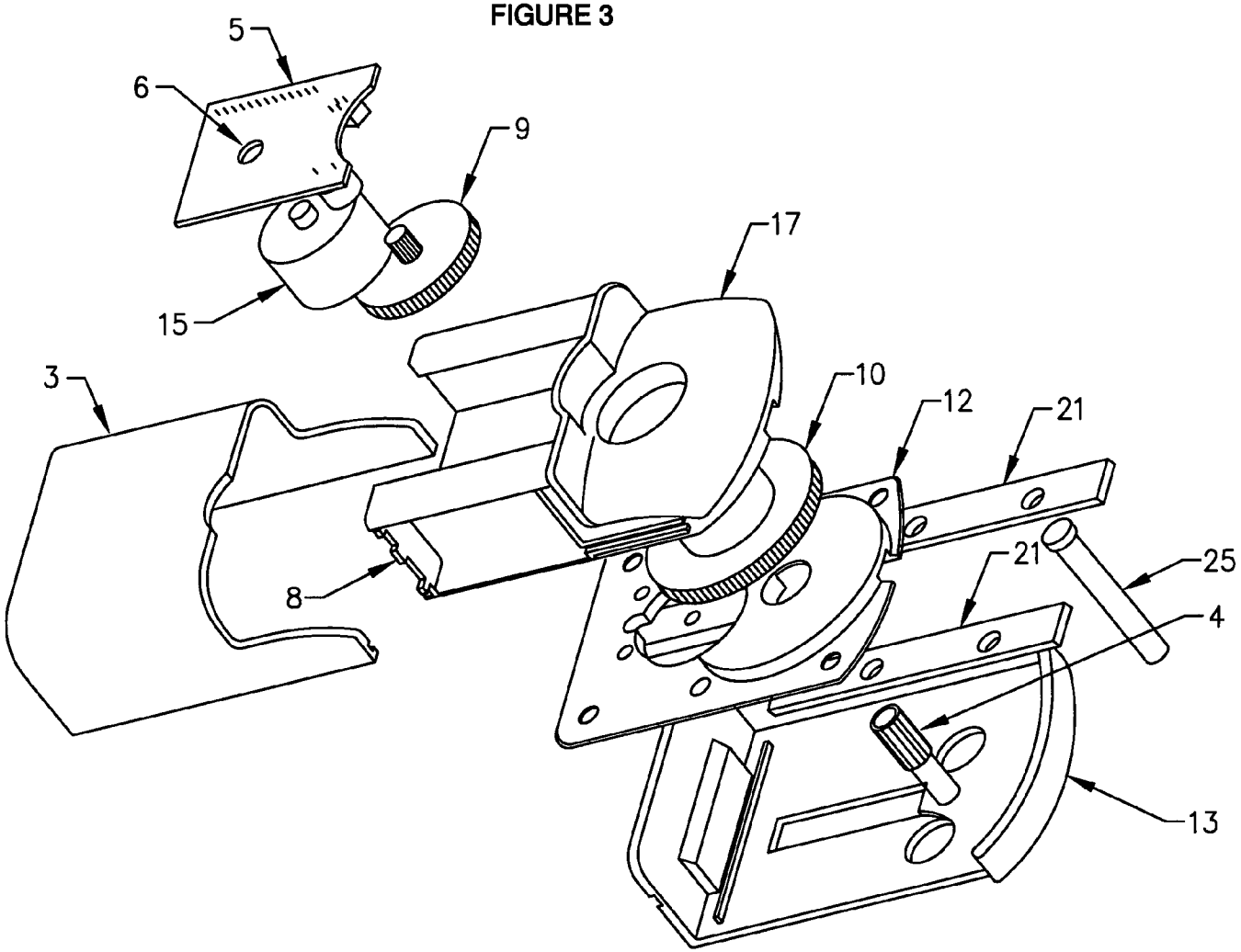
FIG. 3 illustrates a top fully exploded view of the apparatus which is the subject of the current invention.
Figure 4:
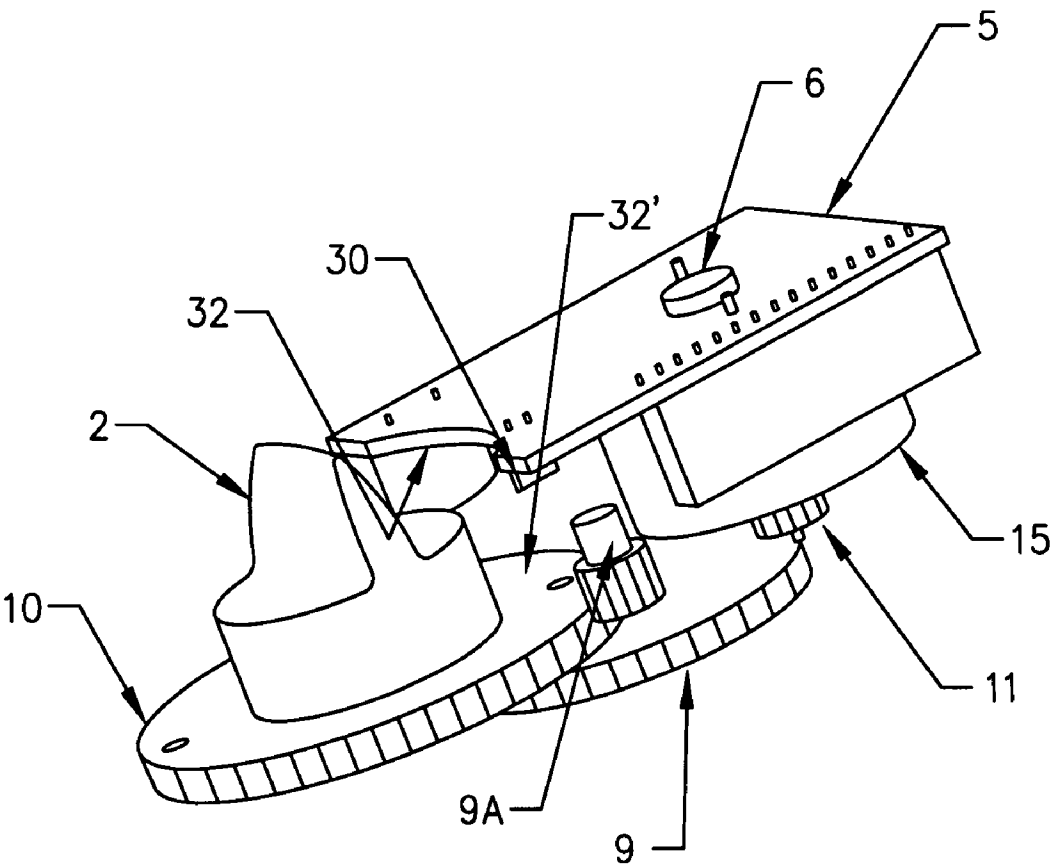
FIG. 4 illustrates a side view of the apparatus motor and gears which is the subject of the current invention.

FIG. 3 shows an exploded view of the apparatus as seen from an upper view of the unit base 1. Present are all of the elements needed to make a complete apparatus as previously indicated in FIGS. 1 and 2. Splined stem 4 releasably attaches to knob gear 10 in a conventional manner such that when knob gear 10 rotates either through manual rotation (via use of finger(s) and thumb) or through motorized rotation (via the use of motor 15) deadbolt turning bolt rotates thereby actuating the standard and conventional deadbolt 27 in the door or barrier 24 to expand or contract thereby locking the door or unlocking the door respectively.

Figure 8:
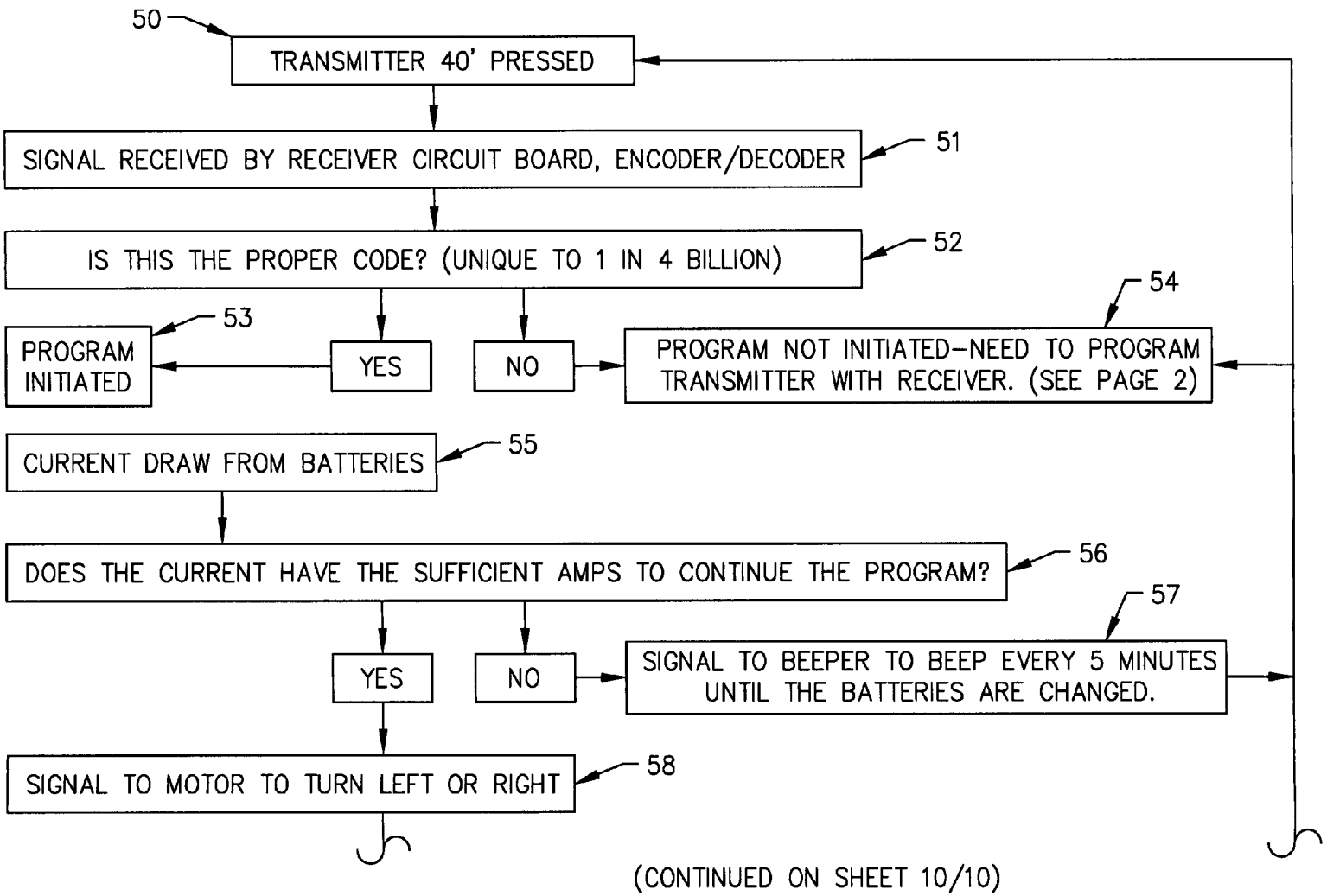
FIG. 8 illustrates the flow chart of the program associated with the electronic card which is the subject of the current invention.
Figure 8:
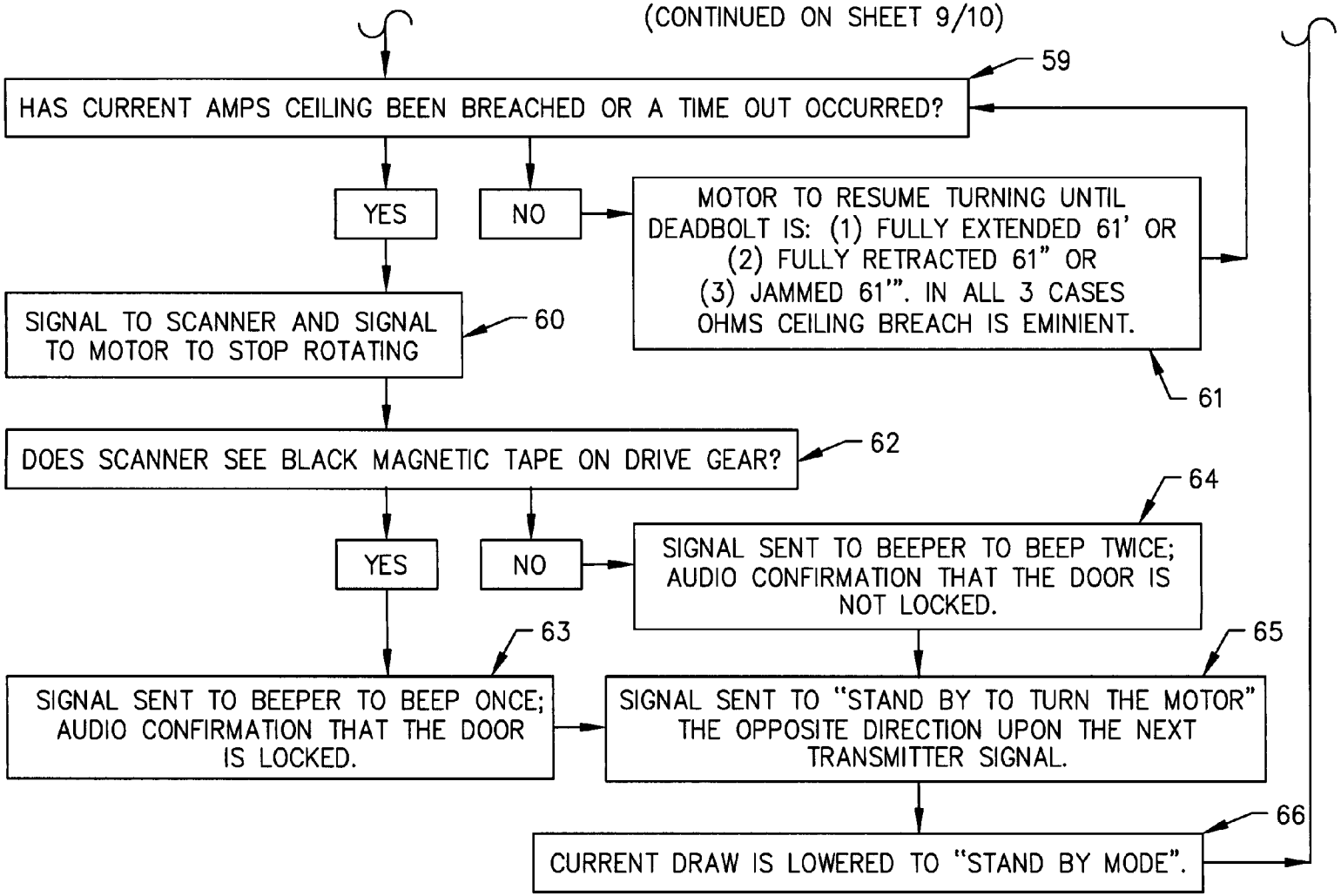

FIG. 4 illustrates a side view of the motor gear arrangement. Electronic card 5 preferably is ensconced on motor 15 and is in electronic communication with motor 15 in a manner that is conventional in the art. Electronic card or circuit board 5 is of the type conventionally found and used in the industry to actuate a motor engine to rotate. Examples of electronic card or circuit board 5 can be, but are not limited to, electronic card or circuit boards utilized in remote car locks and alarms which work by radio signal such as ones developed by the Mesa Corporation. Unique circuit board programming and a logic flowchart can be found in (FIG. 8). It is important to note that one of skill in the art could readily conceive of an electronic card or circuit board 5 which is activated by radio, infrared or a plurality of other frequency activations. Attached to electronic card or circuit board 5 is the sound emission diode 30 which is designed to activate and emit sound upon the user transmitting the radio frequency instruction to activate. The sound emission diode 30 is preferably designed to sound or beep once if the deadbolt 27 is in the extended position and the door or barrier 24 is locked. However, one of reasonable skill in the art could devise different sound emission combinations or types of sound. The sound emission diode 30 is preferably designed to sound or beep twice if the deadbolt 27 is in the contracted position and the door or barrier 24 is unlocked. The electronic card or circuit board 5 can sense if the deadbolt 27 is extended when sensor 32 is lined up with sensor 32' which is located on the top portion of knob gear 10. It should be noted that when assembled the rotation of knob gear 10 at the full extension of the deadbolt 27 will coincide and be synchronous with the lining up of the sensors 32 and 32'. If the sensors 32 and 32' are not properly lined up or within sufficient distance of each other then two beeps will be issued from the emission diode 30 upon activation, if the sensors 32 and 32' are within sufficient distance then only one beep will be issued from the emission diode 30 upon activation. Sensor 32' is preferably, but not limited to a sensor strip attached on top of knob gear 10. Motor 15 is preferably, but not limited to, a 6-volt standard rotational motor, such as the model WRF-500TB-12500. The motor 15 must be of sufficient output to rotate gears 9, 10 and 11 in such a manner as to actuate the device and extend or retract the deadbolt 27. In operation the motor 15 operates in the conventional manner for a motor utilized to turn at least one gear as used in the art.

As shown in FIG. 4 when motor 15 is activated it rotates motor gear 11 in the conventional manner. Rotation of motor gear 11 can be in a clockwise or counterclockwise motion. Motor gear 11 is preferably constructed to have teeth that are mechanically engaged with rotary gear 9 in such a manner that upon motor gear 11 rotation, rotary gear 9 is caused to rotate in a counter rotating fashion. As shown in the embodiment of the motor unit in FIG. 4 rotary gear 9 has a top side with a toothed knob 9*a* such that the teeth of toothed knob 9*a* are in mechanical communication with knob gear 10. When rotary gear 9 rotates knob 9*a*, knob 9*a* rotates in the same direction therefore causing knob gear 10 to rotate in a counter-rotational direction. Since manual deadbolt turning knob 2 is attached and adjacent to knob gear 10, it too rotates in the same direction as knob gear 10. Depending on the signal received by the electronic card or circuit board 5 the motor will be actuated to rotate in a clockwise or counterclockwise manner thereby causing the manual deadbolt turning knob 2 to rotate in a clockwise or counterclockwise manner. Since the manual deadbolt turning knob 2 is connected to the splined stem 4 the deadbolt turning member 4 will also rotate on the same axis as the manual deadbolt turning knob 2. The rotation of the splined stem 4, which is in mechanical communication with the internal door deadbolt apparatus 28, will cause the mechanical internal deadbolt apparatus 28 to rotate and thereby extend or contract the actual deadbolt 27, pending the signal received by the electronic card or circuit board 5.

Figure 5:
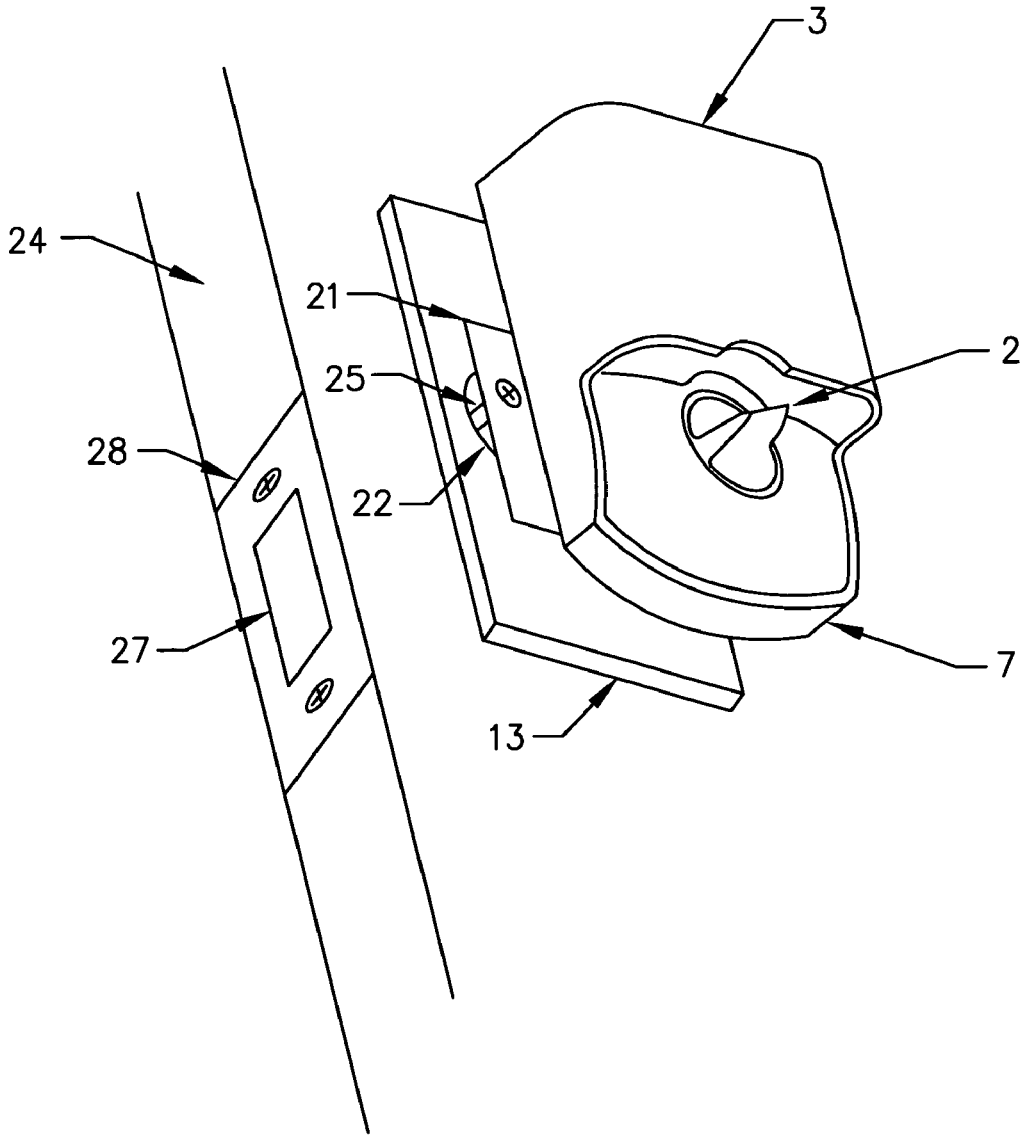
FIG. 5 illustrates the apparatus as attached to a door in a partially exploded view which is the subject of the current invention.

FIG. 5 illustrates an embodiment of the unit base 1 in a partially exploded view of the apparatus as attached to a door or barrier 24. The back casing 3 is already attached and placed on motor and battery housing unit 7. Also visible is the manual deadbolt turning knob 2 in mechanical communication with the gears and splined stem 4 as described in detail above. Template 13 is securely attached to door or barrier 24 by the use of two bolts 25 which are of the type conventional to the industry and typically supplied and used in conjunction with a standard internal deadbolt apparatus 28. Template 13 is cast to preferably include orifices 22 which are of a significant diameter to allow for a bolt 25 from any mainstream standard internal deadbolt apparatus 28 to pass through the orifice 22. The orifices 22 are cast in such a manner to allow for the deadbolt unit base 1 to be secured to any mainstream internal deadbolt system and apparatus thereby allowing for a wide range of deadbolt activation applications. The bolts 25 are inserted through brackets 21 and securely fix the brackets 21 to the template 13 thereby securely attaching template 13 to the door or barrier 24 as well. Brackets 21 are preferably dimensioned to easily traverse the orifice 22 in such a manner as to prevent the brackets 21 from falling into the orifice 22 and dis-attach the deadbolt unit base 1 from the door or barrier 24. Brackets 21 are also preferably in communication with the template 13 in such a manner as to prevent the template 13 from slipping or sliding in relation to the door or barrier 24. The brackets 21 attach to the template 13 preferably in such a manner as to keep the template 13 flush with the door or barrier 24. It is important to note that the present apparatus is to be preferably equipped with a "universal" stem or splined stem 4, such that the splined stem 4 can be utilized and adapted to fit virtually all brands of single cylinder, cylindrical deadbolt locks. It is important to note that the unit base 1 retains and can be utilized with the keys already in existence with the previously installed deadbolt, which is required by some states laws regarding rental properties. It is important to note that because of the compact size and contoured construction that the apparatus will allow for the apparatus to fit within the space constraints as governed by many states laws. It is important to note that the apparatus does not damage the door or barrier upon which it is mounted because it mounts on the existing deadbolt screws and has adjustable brackets which can allow for any standard variation between screw spacing and length. It is important to note that the apparatus operates on left or right swinging doors, without adjusting the apparatus.

Figure 6B:
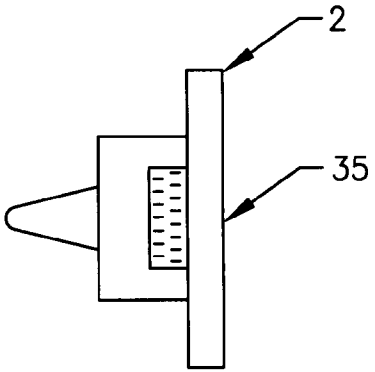
FIG. 6B illustrates a side view of the manual turn knob and turning members which is the subject of the current invention.

The unit base 1 is assembled in substantially, but not limited to, the following manner. In order for the apparatus to be assembled on a door or barrier 24, door or barrier 24 must first be equipped and/or have an already existing standard deadbolt system. If one is not provided on a door or barrier 24 then the user can purchase any standard existing single cylinder, cylindrical door deadbolt system and install it in the door or barrier prior to installing the unit base 1. It is important to note that unit base 1 can work in conjunction with existing door deadbolt locks and is an adaption device meant to be used with existing door deadbolt locks. The unit base 1 can be sold in a package in which it is included with a standard deadbolt lock assembly as well. The standard deadbolt lock thumb turn that is exitwise to the door is removed in the conventional manner of the art. After removal of the standard deadbolt lock exitwise backing, left internal to the door or barrier 24 is the internal deadbolt mechanism 28, which is conventional to the type of standard deadbolt lock system used. Included in this would be a plurality of bolts 25 (usually two of them) and a tailpiece for turning the deadbolt internal mechanisms 28 in a clockwise or counterclockwise rotation. The term "exitwise" for the purpose of the patent refers to side of the door or barrier 24 which face the inside of the room or enclosure sought to be secured. The term "entrywise" refers to the opposite side of the door or barrier 24. The distance and spacing of the bolts 25 varies between the standard deadbolt brands. After removal of the standard deadbolt lock exitwise backing the template 13 is lined up to fit over the bolts 25 and rotational stem of the standard deadbolt lock unit such that the bolts 25 are in the center of the orifice 22 and preferably do not touch the sides of the orifice 22. It is important to note that the user has the option of pulling out the splined stem 4 from its attachment to the manual turn knob 2 and rotate it such that either the front face can be utilized having a standard slot formation 34 or with a half oval face as seen in 34' or cross-slot formation 34" (FIG. 6C). The purpose of this dual facing on this stand is such that it can be used with plurality of standard deadbolt locks including ones found in most standard configurations. It is important to note that the unit base 1 can be installed on either a ½ inch or one inch deadbolt 27 without adjusting the internal gears 9, 10, or 11. This type of installation is initiated by fully extending the deadbolt 27 prior to attaching the unit base 1 to the door or barrier 24. By attaching the apparatus in this manner the sensors 32 and 32' will be lined up when the deadbolt 27 is fully extended and thereby will act as the baseline for when the deadbolt 27 will register as fully extended. When the gears 9, 10, and 11 rotate the sensor 32' will be moved distal to the sensor 32 and thereby will indicate (if activated) that the deadbolt 27 is not in the extended position. Two bolts 25 are attached to the brackets 21, they effectively bridge the orifice 22 such that the orifice 22 and the brackets 21 are engagably locked, whereby the entire template 13 is no longer moveable and is releasably held to the door 24. At this time the rest of the unit which includes the fill up motor battery and housing unit 7 and the back casing 3 are placed together with all elements and gears present inside and attached to the template 13 such that the unit can be primed for working.

Figure 6A:
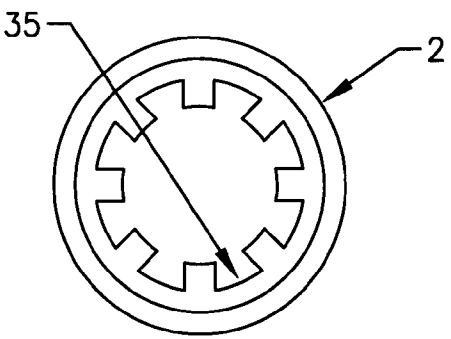
FIG. 6A illustrates a front view of the manual turn knob and turning members which is the subject of the current invention.
Figure 6C:
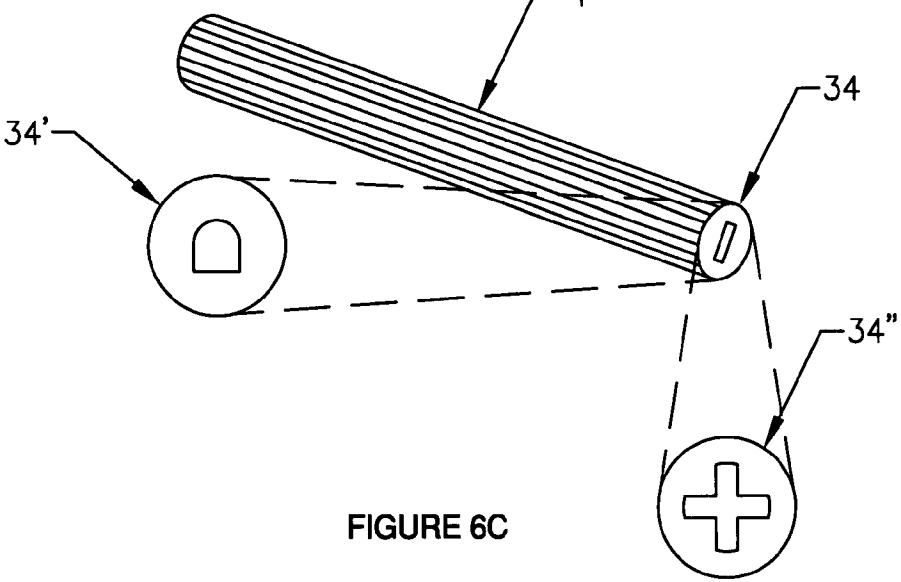
FIG. 6C illustrates turning members which is the subject of the current invention.

FIG. 6A shows the engagement portion of the manual deadbolt turning knob 2. FIG. 6B shows the engagement face 35 which faces the splined stem 4. The engagement face 35 is splined such that it can engagably receive the splined stem 4 in such a manner as to reasonably hold it in place so that upon rotation of the manual turn knob 2 the splined stem 4 can be rotated at the same rate and along the same axis.

It is important to note that batteries of appropriate size must be placed in the battery casing unit 7 in the battery bank 8 such as to provide power for the unit to function. Upon attachment of the complete unit base 1 to the door such that the splined stem 4 mechanically engages the standard deadbolt tailpiece unit is ready for activation. Activation occurs when the user takes the transmitter 40 preferably, but not limited to, within a ten foot proximity to the unit base 1 and the covering for back casing 3 is removed from the apparatus. Upon such time the signal set button 6 is depressed wherein a code is transmitted from the electronic card 5 to the transmitter wherein the transmitter 40 and the electronic card or circuit board 5 are thereby in electronical and in computer communication with each other wherein the transmitter 40 can now transmit a receiving signal to the electronic card or circuit board 5 which in turn will activate the motor is in unit base 1. In further explanation of the functioning of the unit 1 when the proper sequence button is depressed on the transmitter (41, 42, or 43), it will transmit via radio frequency or other electronic frequency to the electronic card or circuit board 5 wherein the electronic card or circuit board 5 shall receive the signal 44 and to relay the signal if proper to the motor 15 whereby the motor 15 will become actuated and shall rotate motor gear 19. The signals 44 received by the electronic card or circuit board 5 can transmit information in three, but not limited to three, different ways or fashions: the first method is to cause rotation of the motor 15 whereby the deadbolt 27 is caused to extend, the second is to cause rotation of the motor 15 the deadbolt 27 contracts, and the third is a signal sent to the electronic card or circuit board 5 to transmit data if the deadbolt 27 is in an extended or contracted position in relation to the door or barrier 24. If the first type of signal is transmitted from the transmitter 40 as mentioned, the deadbolt 27 will extend unless the deadbolt 27 is already fully extended in which case no further gear (9, 10, or 11) rotation is possible. If a second type of signal is transmitted then the deadbolt will contract through rotation of the gears 9, 10, or 11 whereby the door or barrier 24 will become opened. If the third type of signal is transmitted the sound emission diode 30 will beep or actuate sound wherein if the deadbolt 27 is fully extended one beep preferably shall be emitted and if the deadbolt 27 is contracted, two beeps shall be emitted. It is important to note that one skilled in the art could arrange for a series of sounds or different sounds to be transmitted by the electronic sound emission diode 30 wherein the user would be able to understand and receive information about the extension or contraction of the deadbolt 27. It is also important to note that the system preferably uses a computer algorithm as currently developed which has a one in 4 billion chance combination for signal transmission 44 thereby providing added security of not allowing interception and retrieval of signal information from either the transmitter 40 or from the electronic card or circuit board 5.

When the electronic card or circuit board 5 is actuated and the signal 44 is received for an extension of the deadbolt 27, the signal is relayed via electronic communication to the motor 15 which will activate and cause a rotation of the motor gear 11. As aforementioned and described, motor gear 11 has motor teeth which are engaged mechanically with the motor teeth on rotary gear 9, such that when motor gear 11 rotates, rotary gear 9 shall rotate in a counter rotational movement due to the teeth and gears. The top portion of rotary gear 9 is preferably threaded with teeth as well and in mechanical communication with knob gear 10 such that knob gear 10 shall rotate counter rotationally to rotary gear 9 upon activation of motor gear 11. Knob gear 10 as aforementioned is in mechanical communication and direct contact with manual deadbolt turning knob 2 and thereby with turning splined stem 4 such that the rotation of knob gear 10 will cause rotation about the same axis for splined stem 4. Splined stem 4 is in mechanical communication and is releasably attached to the standard deadbolt tailpiece so upon rotation of splined stem 4 the standard deadbolt tailpiece will also rotate whereby it shall cause the deadbolt 27 to extend in the standard manner for a standard deadbolt lock. The deadbolt 27 will then preferably be extended into the doorframe whereby assurance in safety is provided to the user that the deadbolt 27 is in place. In order to contract the deadbolt 27, a second signal shall be sent by the transmitter 44 to the electronic card 5 wherein the motor will be actuated to rotate in a manner counter to the rotation which will cause deadbolt 27 extension. As such motor gear 11 shall rotate in the counter rotation movement as shall rotary gear 9 in relation to motor gear 11 and as shall knob gear 10 in relation to rotary gear 9. The counter rotation of knob gear 10 as opposed to the rotation for causing extension of the deadbolt 27 will be such that the stem which is attached to the manual deadbolt turning knob 2 which is in communication mechanically with the knob gear 10 shall also rotate counter to the motion needed for deadbolt 27 extension. Because the splined stem 4 is in mechanical communication and releasably attached to the tailpiece for the standard deadbolt unit counter rotation will cause the gears inside the standard deadbolt unit to rotate in the manner to cause the deadbolt 27 to contract.

Figure 7:
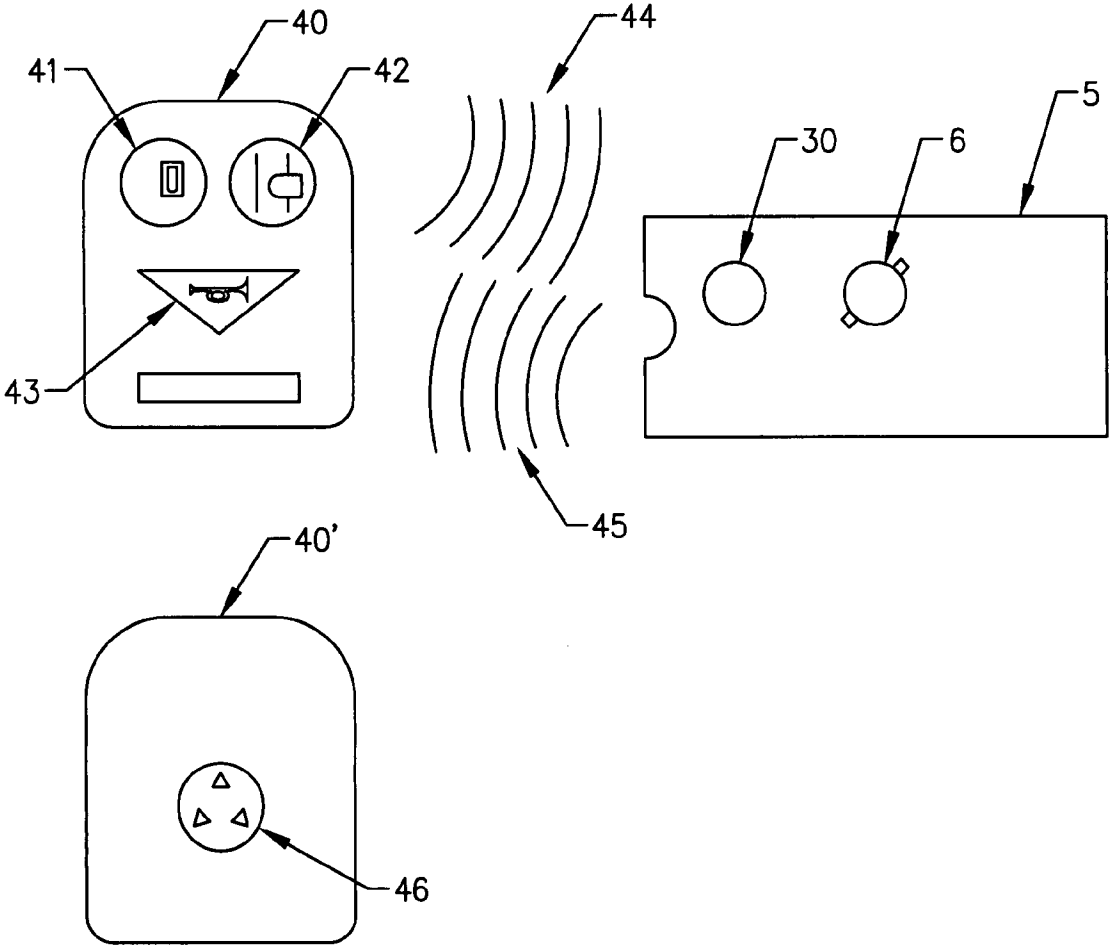
FIG. 7 illustrates the transmitter and electronic card of the apparatus working in tandem which is the subject of the current invention.

FIG. 7 illustrates the transmitter 40 and the electronic card or circuit board 5 working in tandem. The user can determine if the deadbolt 27 is extended without having to manually test the door by depressing the sound emission diode transmission signal 43 on the transmitter 40 whereby the sound emission diode 30 will transmit a noise indicative of the position of the deadbolt 27. The deadbolt 27 position is determined because preferably on knob gear 10 there is a transmission strip 32' and on the back of the electronic card or circuit board 5 there is a transmission sensor strip 32 wherein if the transmission strips are within the certain distance of each other they will indicate and transmit a signal indicative of the distance and position between themselves. Because of this, when the knob gear 10 is in rotation and the transmission strip 32' is as distal as it can be from transmission strip 32 there will be no transmission signal between the two and therefore the sound emission diode 30 shall emit an indicative noise to indicate that the deadbolt 27 is not extended. If the transmission strip 32' and the transmission strip 32 are preferably lined up to be parallel in such a position as to be within the distance, preferably less than one centimeter, from each other, then a transmission signal between the two shall be established and the sound emission diode 30 will indicate that the deadbolt 27 is in the extended position. It is important to note, for the user, however that the extension of the deadbolt 27 does not necessarily indicate that the deadbolt 27 is fully placed within the doorframe and that the house or area to be secured is fully secured. This unit may be operated and used if the door is ajar in which case deadbolt 27 can be extended for purposes for checking the efficacy and safety of the unit without actually locking the door. It is also important to note that the size of the unit base 1 is so constructed as to fit almost any standard deadbolt unit to be utilized in an apartment. Likewise, the back casing 3 can be constructed and molded such as to fit deadbolt locks with upper locking bolts in close proximity such that the back casing unit has an ovular or circular shape fitting more deadbolt locks. It is important to note that one skilled in the art could readily conceive that the unit base 1 allows for a plurality of transmitters 40 that can be programmed for use with the unit base 1 and the electronic card or circuit board 5.

FIG. 7 further illustrates the interaction between the transmitter 40 and the electronic card or circuit board 5. In order to activate the unit base 1, the signal set button 6 must be depressed. Upon depression of signal set button 6 an activation signal 45 will be transmitted to the transmitter 40 thereby linking and synchronizing the electronic card or circuit board 5 with the transmitter 40. Upon this activation it is preferable that only the transmitter 40 and the electronic card or circuit board 5 can electronically communicate with each other, and that preferable a decoding/encoding system is used such that only one in 4 billion alphanumeric sequences will activate the electronic card or circuit board 5. This type of decoding/encoding is conventional in the art. It is also preferable that the transmission code can be regenerated and retransmitted to the transmitter 40 subsequent to every use of the unit base 1. This type of retransmission is conventional in the art. Transmitter 40 is conventional in the art and is preferably of the same size and same power as a standard electronic car door lock transmitter. It is also preferable, but in no way limited, that the transmitter 40, work on the same frequency as a standard electronic car door lock. The transmitter 40 contains an electronic card or circuit board component and battery component standard in transmitters of like size used in electronic car locks. The transmitter 40 has preferably, but not limited to, three depressible buttons on its outer carapace. Retraction button 41, upon depression, sends an electronic signal to the electronic card or circuit board 5 in a manner conventional to the art. The electronic card or circuit board 5 then receives the signal 44 and internally signals the motor (shown in FIGS. 1 and 2) to activate and cause the motor gear 11 to rotate in such a manner as will end up resulting in the deadbolt 27 being retracted. (See earlier description of deadbolt retractions and extensions.) To verify that the deadbolt 27 has been retracted, user may depress the sound emission diode transmission signal 43 on the transmitter 40. Upon depression the transmitter 40 will send a signal 44 to the electronic card or circuit board 5, whereupon the electronic card or circuit board 5 can receive the signal 44 and internally signal the sound emission diode 30 to activate, thereby preferably chirping once if the deadbolt 27 is extended and twice if the deadbolt 27 is retracted. It is important to note that anyone of ordinary skill in the art could conceive of a plurality of audio-electronic arrangements which could be used to indicate the position of the deadbolt 27. Electronic card or circuit board 5 can also transmit data to and signals 45 to the transmitter 40 such as when the electronic card or circuit board 5 and transmitter 40 are synchronized upon unit base 1 activation, or when the electronic card or circuit board 5 generates a new signaling sequence, preferably after each transmission 44 by the transmitter 40. Sound emission diode transmission signal 43 when depressed will activate the sound emission diode 30 to indicate that the unit is functioning. It is important to note that new signal generation could occur after a few transmissions or after one single transmission.

An alternate embodiment of the transmitter can be found in transmitter 40' whereby all functions of transmitter 40 could be conducted by depressing the button 46 on transmitter 40' in a series of depressions, which could be, but is not limited to one depression activating the logic flow programming of the electronic card (FIG. 8) which would either cause the deadbolt 27 to extend or retract.

FIG. 8 illustrates the electronic card 5 logic flow chart. It commences when the transmitter 40' is depressed. Upon pressing the transmitter button a signal is received 51 by the electronic card or circuit board 5. Electronic card 5 is equipped with an encoder and decoder that is standard in the industry. The code is then identified and decoded by the electronic card 5 to see if the code is proper 52. If the code is proper then the electronic card program is initiated 53. If the code is not proper then the program is not initiated and the transmitter needs to be reprogrammed with the receiver 54. The program can be reprogrammed by activating and repressing the signal set button 6. After the signal is reset the transmitter can be pressed again restarting the logic flow process 50. If the program is initiated 53 then current is drawn from the batteries 55 housed in the battery bank 8. The program then determines if there is sufficient amperage running from the batteries to continue the program 56. If the current does not have sufficient amperage to continue running then a signal will be sent to the sound emission diode 30 and the transmitter to emit sound, preferably but not limited to every 5 minutes until the batteries are changes 57. After the batteries are changed the transmitter can be pressed again restarting the logic flow process 50. If there is sufficient amperage then the motor 15 will be signaled to rotate clockwise 58. It should be noted that an alternate embodiment of the inventive system could involve a motor 15 and electronic card 5 hook up that would be arranged for the motor to rotate counterclockwise as its first rotation. The first rotation as referenced in this patent refers to the initial rotation upon installation of the base unit 1. It should also be noted that upon activation the motor 15 will alternatively change the direction of its rotation with each successful use of the logic flow program, wherein the activation will extend the deadbolt 27 upon one use and then retract the deadbolt 27 upon a subsequent use, and so on. It should be noted that the electronic card 5 is programmed to register and respond to the amperage level running through the circuit board and exiting the battery. The electronic card 5 is programmed to register a ceiling value for amperage running through the motor and also read and register if the ceiling value has been surpassed 59 or a "time out" occurs. A "time out" occurs when the motor 15 has run for preferably, but not limited to, 2.5 seconds in which case the motor will lower current and will stop rotating as if the ceiling level value has been breached. If the ceiling level value, preferably but not limited to the value of 1.2 amps, has been surpassed then the motor 15 is signaled to stop rotating and a signal is sent 60 to the sensor 32 to register the position of the gear 10. The amperage ceiling will be met and exceeded when the deadbolt 27 reaches a barrier, such as full extension, or full retraction by which the motor 15 will not be able to overcome with out increasing the amperage. If the amperage ceiling level have not been reached then the motor 15 will continue to rotate thereby moving the deadbolt 61 until the deadbolt 27 is extended 61', retracted 61", or jammed 62". Upon full extension, retraction or being jammed the amperage ceiling will be met and the motor 15 is signaled to stop rotating and a signal is sent 60 to the sensor 32 to register the position of the gear 10. The sensor 32 will then register 62 if it is in proximity to the sensor strip 32'. If the sensor 32 is in proximity to the strip 32' then a signal is sent to the sound emission diode 30 to emit a sound once confirming that the deadbolt 27 is fully extended 63. If the sensor 32 is in not in proximity to the strip 32' then a signal is sent to the sound emission diode 30 to emit a sound twice confirming that the deadbolt 27 is retracted 64. Regardless of which signal 63 or 64 is sent to the electronic card 5 a second signal is sent to the motor 15 initiating the motor 15 to alter its rotation for the next reception of a signal 65 and lower the current being drawn from the batteries 66 on the battery bank 8 until the transmitter is presses again 50.

It may be seen from the preceding description that a new and improved electronic deadbolt moving system and method has been provided. Although very specific examples have been described and disclosed, the invention of the instant application is considered to comprise and is intended to comprise any equivalent structure and may be constructed in many different ways to function and operate in the general manner as explained hereinbefore. Accordingly, it is noted that the embodiment of the new and improved electronic deadbolt system and method described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense. It should also be noted that the new and improved electronic deadbolt moving system can be used with any universally single cylinder, cylindrical deadbolt system.

I claim:

1. A system for remotely opening and closing a pre-existing deadbolt lock comprising:

a pre-existing deadbolt lock;

a signal transmitter;

a housing remote from the transmitter, said housing configured to be mounted utilizing only the existing mounting screws of said pre-existing deadbolt lock;

the housing further comprising;

a motor having an output shaft;

a signal receiver attached to the motor;

a reversible elongated member having a first end and a second end, each of said first end and said second end having an inner surface and an outer surface, wherein said outer surface of each said first end and said second end is configured for communication with said motor output shaft; and said inner surface of said first end or said second end of said reversible elongated member being in direct contact with a tailpiece member of said pre-existing deadbolt lock with a deadbolt, wherein said reversible elongated member is configured such that the combination of the configurations of said inner surface of said first end and said second end are adaptable to substantially all tailpiece members of pre-existing deadbolt locks regardless of manufacturer configurations, whereby the signal receiver receives a signal from the signal transmitter causing the motor to activate, wherein the rotation of the output shaft of the motor causes the elongated member to rotate, and wherein the elongated member through direct contact with the tailpiece member rotates the tailpiece member, thereby causing the deadbolt to extend or retract.

2. The system of claim 1 further comprising a gear attached to the motor, wherein the first end of the elongated member is attached to the gear.

3. The system of claim 1, wherein the signal receiver is an electronic card.

4. The system of claim 3, further comprising:

a sound emitting module; and the electronic card is connected to the sound emitting module, whereby a sound is emitted from the sound emitting module to indicate when the deadbolt is in a locked or unlocked position.

5. The system of claim 1, wherein said second end of said elongated member is in communication with said motor and said first end is in communication with tailpiece member of the deadbolt lock.

6. The system of claim 5, wherein said elongated member is configured such that both said first end and said second end are capable of communication with said motor, and wherein said first end and said second end are configured to attach to different shaped tailpieces of different designed deadbolt locks.

7. The system of claim 1 further comprising at least one bracket, said bracket permitting the adjustment of said housing to mount to variously designed deadbolt locks.

8. A system for remotely opening and closing a pre-existing deadbolt comprising:

a pre-existing deadbolt lock;

a signal transmitter;

a base further comprising;

a motor, whereby the base houses a motor;

a signal receiver in electronic communication with the motor;

a gear in mechanical communication with the motor;

an elongated member, having a first end and a second end, said first end being in mechanical communication with the gear, whereby said second end of the elongated member is in direct contact with a tailpiece member of internal extension and contraction mechanisms of a deadbolt lock with a deadbolt, and whereby the signal receiver receives a signal from the signal transmitter causing the motor to activate, wherein activation of the motor causes the gear to rotate such that the gear, in mechanical communication with the first end of the elongated member, thereby actuating the elongated member to rotate the tailpiece member of the internal mechanisms in the deadbolt lock causing the deadbolt to extend; and a tracking system comprising a sensor and a sensor recognition point, said sensor recognition point configured to indicate a specific position of said pre-existing deadbolt lock, wherein said sensor tracks the movement of said system and emits an audible sound, said audible sound indicating if said sensor recognition point has been detected by said sensor, wherein the elongated member further comprises a splined stem having a first and second end, and wherein the first and second end further comprises a face on each end, and wherein the first end face comprises substantially a half oval shape orifice, and wherein the second end face shape comprises substantially a rectangular or cross shaped orifice.

9. The system of claim 8, wherein the base further comprises:

a battery housing unit;

gear casing; and a template unit, said template unit configured for mounting the base to the deadbolt lock utilizing existing deadbolt lock mounting hardware, wherein the battery housing unit, gear casing, and template unit are releasably attached to each other.

10. The system of claim 8, whereby the base further comprises: an attachment member for releasably attaching the base to a door, said attachment member comprising a templet unit and at least one bracket unit, wherein existing hardware can be utilized for said attaching.

11. A method of moving a deadbolt comprising the steps of:

determining the cross-sectional shape of a tailpiece member of a pre-existing deadbolt system;

attaching a deadbolt activating system to said pre-existing deadbolt system with internal mechanisms and a deadbolt, wherein attaching further comprises selecting the end of a reversible elongated member which matches the determined cross-sectional shape of said tailpiece member of said pre-existing deadbolt system and attaching said matching components;

sending a signal via a transmitter;

electronically activating an electronic input card housed in the deadbolt activating system via reception of the signal;

signaling a motor with the electronic card via electronic and mechanical communication;

activating a gear, via the motor, housed in the deadbolt activating system to rotate;

housing said reversible elongated member, in mechanical communication with the gear, in the deadbolt activating system, whereby the rotation of the gear causes the rotation of the reversible elongated member which is releasably and directly attached to said tailpiece member of internal mechanisms of said pre-existing deadbolt system causing the deadbolt to extend; and providing a tracking system comprising a sensor and a sensor recognition point;

tracking said sensor recognition point, said sensor recognition point configured to indicate a specific position of said pre-existing deadbolt lock;

indicating if said recognition point has been detected by said sensor; transmitting said indication to a sound emitting module; and emitting a sound from said sound emitting module to indicate when the deadbolt is in the locked position and/or in the unlocked position, wherein said locked and/or unlocked position is based on said indication.

12. The method of claim 11, whereby the rotation of the internal mechanisms causes the deadbolt to retract.

13. The method of claim 11, further comprising providing a plurality of gears housed in the deadbolt activating system.

14. The method of claim 11, further comprising composing the deadbolt activating system of a gear carriage, a motor and battery carriage and a gear base.

15. The method of claim 14, further comprising attaching the deadbolt activating system to a door by use of existing deadbolt screws.

16. The method of claim 15, further comprising:

constructing the door or barrier with a top and a bottom; and attaching the deadbolt activating system to a door or barrier at a distance between thirty six inches and forty eight inches from the bottom of the door or barrier.

17. The method of claim 15, further comprising removing the deadbolt activating system from a door; whereby the removal of the deadbolt activating system does not damage the door.

18. A method for remotely extending and retracting a pre-existing deadbolt comprising:

sending a signal from a transmitter;

providing a deadbolt turning system with a motor and a signal receiver, said signal receiver being an electronic card;

attaching said deadbolt turning system to a pre-existing deadbolt lock;

attaching the signal receiver to the motor;

receiving the signal from the transmitter through the signal receiver;

determining the cross-sectional shape of a tailpiece member of a pre-existing deadbolt lock;

positioning one end of a reversible elongated member to be in communication with the motor;

attaching a second end of the elongated member directly to a tailpiece member of internal extension and contraction mechanisms of a deadbolt lock with a deadbolt, wherein said second end is selected to match the cross-sectional shape of said tailpiece member of said pre-existing deadbolt lock;

providing a tracking system comprising a sensor and a sensor recognition point;

tracking said sensor recognition point, said sensor recognition point configured to indicate a specific position of said pre-existing deadbolt lock;

indicating if said recognition point has been detected by said sensor; transmitting said indication to a sound emitting module; and constructing the electronic card with the sound emitting module, whereby a sound is emitted from the sound emitting module to indicate when the deadbolt is locked and/or unlocked, wherein the locked and/or unlocked position is based on said indication, and whereby, the signal receiver receives a signal from the signal transmitter causing the motor to activate, wherein activation of the motor causes the elongated member to rotate, and wherein the elongated member rotates the tailpiece member of the internal mechanisms in the deadbolt lock, thereby causing the deadbolt to extend or retract.

19. The method of claim 18, further comprising:

attaching the elongated member to a gear; and attaching the gear to the motor.

20. The method of claim 18, whereby the rotation of the internal mechanisms causes the deadbolt to retract.

* * * * *